US006352808B1

(12) United States Patent
Hagi et al.

(10) Patent No.: US 6,352,808 B1
(45) Date of Patent: Mar. 5, 2002

(54) ELECTROSTATIC-LATENT-IMAGE DEVELOPING TONER AND INORGANIC PARTICLES USED FOR SUCH A TONER

(75) Inventors: Masayuki Hagi, Mino; Takeshi Arai, Akashi; Yoshihiro Mikuriya, Nishinomiya; Yoshitaka Sekiguchi, Nishinomiya; Kenichi Kido, Nishinomiya; Megumi Aoki, Itami; Tetsuo Sano, Amagasaki; Junichi Tamaoki, Sakai, all of (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/669,555

(22) Filed: Sep. 26, 2000

(30) Foreign Application Priority Data

Sep. 30, 1999 (JP) ..... 11-278957

(51) Int. Cl.[7] ..... G03C 9/00
(52) U.S. Cl. ..... 430/108.1; 430/108.4
(58) Field of Search ..... 430/108.1, 108.4

(56) References Cited

U.S. PATENT DOCUMENTS 5,248,581 A 9/1993 Nakayama et al. ..... 430/106.6
5,378,572 A 1/1995 Akiyama et al. ..... 430/110
5,604,071 A 2/1997 Okado et al. ..... 430/110
5,837,413 A 11/1998 Yada et al. ..... 430/106.6
6,117,605 A * 9/2000 Chiba ..... 430/108.1

FOREIGN PATENT DOCUMENTS

EP 0 744 668 A2 11/1996
JP 60-198556 10/1985
JP 02-89064 3/1990
JP 05-66607 3/1993

* cited by examiner

*Primary Examiner*—Mark Chapman
(74) *Attorney, Agent, or Firm*—Burns, Doane, Swecker & Mathis, LLP

(57) ABSTRACT

The present invention relates to an additive agent for toner, comprising:

inorganic particles;

a first fatty-acid metal salt existing on the surface of the inorganic particles, the first fatty acid metal salt having a metal that is an alkali metal; and a second fatty-acid metal salt existing on the surface of the inorganic particles, the second fatty-acid metal salt having a metal other than an alkali metal, a ratio of the first fatty-acid metal salt to the second fatty-acid metal salt being set in a range of 0.01 to 0.5% by weight;

and a toner containing toner particles and the additive agent.

20 Claims, No Drawings

ELECTROSTATIC-LATENT-IMAGE DEVELOPING TONER AND INORGANIC PARTICLES USED FOR SUCH A TONER

This application is based on application No. 278957/1999 filed in Japan, the contents of which are hereby incorporated by reference.

BACKGROUND OF THE INVENTION

1. Field of the Invention

The present invention relates to an electrostatic-latent-image developing toner used for electrophotography, electrostatic printing, etc. and inorganic particles used for such a toner.

2. Description of the Related Art

It has been widely known that in an attempt to impart a desired fluidity to a toner used for electrophotography, electrostatic printing, etc., inorganic particles, such as silica and titania, are externally added to the toner. In particular, along with the recent demands for digitized and high-quality images, there have been ever-increasing demands for small-size toners. In order to impart a desired fluidity to such a small-size toner, a large amount of fluidizer is required. In the case of full-color toners in which the above-mentioned requirements are demanded most strictly, not less than 1% of inorganic particles having a ultra-fine particle size with an average primary particle size in the range of approximately 10 to 50 nm are externally added to and mixed with the toner.

However, when such a large amount of inorganic particles having a ultra-fine particle size are externally added to the toner, inorganic particles separated from the toner tend to pass through the gap between the photosensitive member and the cleaning blade and to be anchored on the photosensitive member, resulting in BS (black spots) on a copied image. When the anchoring of the inorganic particles occurs on the photosensitive member, the toner accumulates in the vicinity thereof, causing BS to appear as noise in a non-image portion on a copied image.

In order to solve such a problem, a technique has been proposed (Japanese Patent Application laid-open Hei 2-89064) in which hard inorganic particles are externally added to a toner so as to remove the anchored matter on the surface of the photosensitive member through sanding. However, although this technique reduces the occurrence of BS, it makes the surface of the photosensitive member and the cleaning blade susceptible to abrasion, resulting in a reduction of life of these members.

From the viewpoint of prevention of the anchoring on the surface of the photosensitive member, another technique for externally adding fatty-acid metal salt particles to a toner (Japanese Patent Application laid-open Sho. 60-198556) has been proposed. However, in such a technique, since the particle size of the fatty-acid metal salt particles is not less than 3 $\mu$m. This size is rather large. A considerable amount of addition is required in order to efficiently obtain the effect. However, the considerable amount of addition results in degradation in the toner chargeability and the subsequent fog on a copied image.

U.S. Pat. No. 5,378,572 discloses a technique in which an inorganic compound, subjected to a surface treatment by a treatment agent such as a fatty-acid metal salt, is externally added to a toner. In this reference, either a first fatty-acid metal salt or a second fatty-acid metal salt is used as the fatty-acid metal salt. When carrying out the surface treatment, a dispersion solution containing the fatty-acid metal salt dispersed therein is used and to this is added the inorganic compound and stirred. However, such a technique has a difficulty in exerting the BS-reducing effect, and also produces aggregated matters of the inorganic particles that have been surface-treated, resulting in scratches on the surface of the photosensitive member and the subsequent image noise. Similar techniques have been proposed in, for example, U.S. Pat. No. 5,604,071, Japanese Patent Application Laid-Open Hei 5-66607, EP No. 0 744 668 and U.S. Pat. No. 5,837,413; however, any of these techniques have problems of BS and image noise.

SUMMARY OF THE INVENTION

An object of the present invention is to provide an electrostatic-latent-image developing toner which can reduce the anchoring and scratches on the photosensitive member and which is superior in the chargeability, and is also to provide inorganic particles used for such a toner.

Another objective of the present invention is to provide an electrostatic-latent-image developing toner which can reduce the anchoring, scratches and wearing on the photosensitive member and which is superior in the chargeability and cleaning properties, and is also to provide inorganic particles used for such a toner.

The present invention relates to a toner comprising:

toner particles containing a binding resin and a colorant;

an externally additive agent externally added to the toner particle, the additive agent being inorganic particles which have an alkali metal salt of a fatty acid (hereinafter, referred to as a first fatty-acid metal salt) and a non-alkali metal salt of a fatty acid (hereinafter, referred to as a second fatty-acid metal salt) on the surface thereof, the first fatty-acid metal salt having a metal that is an alkaline metal, the second fatty-acid metal salt having a metal that is other than an alkali metal, a ratio of the first fatty-acid metal salt to the second fatty-acid metal salt being set in the range of 0.01 to 0.5% by weight.

DETAILED DESCRIPTION OF THE INVENTION

The present invention provides an electrostatic-latent-image developing toner comprising:

toner particles containing a binding resin and a colorant;

an externally additive agent externally added to the toner particle, the additive agent being inorganic particles which have a first fatty-acid metal salt and a second fatty-acid metal salt on the surface thereof, the first fatty-acid metal salt having a metal that is an alkaline metal, the second fatty-acid metal salt having a metal that is other than an alkali metal, a ratio of the first fatty-acid metal salt to the second fatty-acid metal salt being set in the range of 0.01 to 0.5% by weight.

The present invention also provides an additive agent for toner, comprising:

inorganic particles;

a first fatty-acid metal salt existing on the surface of the inorganic particles, the first fatty acid metal salt having a metal that is an alkali metal; and a second fatty-acid metal salt existing on the surface of the inorganic particles, the second fatty-acid metal salt having a metal other than an alkali metal, a ratio of the first fatty-acid metal salt to the second fatty-acid metal salt being set in a range of 0.01 to 0.5% by weight.

The additive agent for toner is characterized in that a fatty-acid alkali metal salt is added to an aqueous system containing inorganic particles in the presence of metal ions other than alkali metal ions (referred to as "non-alkali metal ions" hereinafter) so as to allow a fatty-acid non-alkali metal salt to deposit on the surface of inorganic particles.

The toner of the present invention is formed by externally adding specific inorganic particles (additive agent for toner) to toner particles. The expression, "externally added", refers to the fact that the inorganic particles are added to the preliminarily prepared toner particles so as to allow them to exist on the surface (peripheral portion) of the toner particles.

In the present invention, each of the inorganic particles externally added to the toner particles is provided with at least a first fatty-acid metal salt and a second fatty-acid metal salt on the surface thereof. In other words, the surface of the externally added inorganic particles of the present invention is coated with at least a first fatty-acid metal salt and a second fatty-acid metal salt, and more preferably, the surface thereof is coated uniformly with at least a first fatty-acid metal salt and a second fatty-acid metal salt.

A ratio of the first fatty-acid metal salt to the second fatty-acid metal salt on the surface of inorganic fine particles is set in the range of 0.01 to 0.5% by weight, preferably in the range of 0.01 to 0.2% by weight. The ratio exceeding 0.5% by weight is not preferable since it causes an extreme reduction in the chargeability when the inorganic particles are added to the toner particles. In other words, the toner is not allowed to obtain a predetermined quantity of charge, resulting in fog on copied images. In the case when the first fatty-acid metal salt only exists on the surface of each inorganic particle in such a small amount that no conventional quantitative analyzing method can detects it, the BS reducing effect is lowered, although the reason for this has not been identified. This case is not preferable. In the present specification, with respect to the above-mentioned ratio, the value measured by a fluorescent X-ray analyzer (SEA2010; made by Seiko Denshi Kogyo K.K.) is used. However, this device is not necessarily used, and any device may be used as long as it can measure the ratio of the first fatty-acid metal salt to the second fatty-acid metal salt existing on the surface of inorganic particles. The minimum value of the above-mentioned rate that is measurable by the fluorescent X-ray analyzer is 0.01% by weight.

On the surface of inorganic particles, the first fatty-acid metal salt and the second fatty-acid metal salt are preferably allowed to exist in an amount that is sufficient in coating the surface with a mono-molecular film. Therefore, the total amount of existence of the first fatty-acid metal salt and the second fatty-acid metal salt on the surface of inorganic particles depends on the specific surface area of organic particles to be used, and more specifically, is preferably set in the range of 0.0001 to 0.05 g, preferably 0.001 to 0.01 g, per 1 $m^2$ of the total surface area of the inorganic particles. The amount of existence per 1 $m^2$ of the total surface area of the inorganic particles is represented by "Z/(XY)" supposing that inorganic particles ((Y)g) having a BET specific surface area X($m^2$/g) have the total Z(g) of the first fatty-acid metal salt and the second fatty-acid metal salt on the surface thereof.

With respect to the material of inorganic particles of the present invention, not particularly limited, any known inorganic particle material in the field of electrophotography and, electrostatic printing, etc. may be used. Examples thereof include: silica, titania, alumina, strontium titanate, barium titanate, zinc oxide, copper oxide, tin oxide and iron oxide.

The inorganic particles prior to being coated with the first fatty-acid metal salt and second fatty-acid metal salt are preferably set to have an average primary particle size of not more than 3 $\mu$m, from the viewpoint of prevention of scratches on the photosensitive member, preferably in the range of 0.01 to 1 $\mu$m, from the view point of preventing the particles from passing through the gap between the photosensitive member and the blade at the time of cleaning. The specific surface area of the inorganic particles is preferably set in the range of 1 to 100 $m^2$/g, preferably 5 to 50 $m^2$/g.

The fatty acids constituting the first fatty-acid metal salt and second fatty-acid metal salt existing on the surface of the inorganic particles may be the same, or different from each other; however, it is preferable to use the same fatty acid. With respect to the fatty acid, not particularly limited, for example, known saturated fatty acids and unsaturated fatty acids may be used. Among these, saturated fatty acids having carbon atoms of 6 to 25, preferably those having carbon atoms of 12 to 20, are preferably used; and examples thereof include: lauric acid, tridecyl acid, myristic acid, pentadecyl acid, palmitic acid, heptadecyl acid, stearic acid, nonadecan acid and arachic acid. Preferably, lauric acid, myristic acid, palmitic acid, stearic acid and arachic acid are used, more preferably lauric acid, palmitic acid and stearic acid are used.

With respect to an alkali metal constituting the first fatty-acid metal salt, not particularly limited, any alkali metal may be used as long as the above-mentioned fatty acid salts are formed, and for example, sodium, potassium, etc. may be used. Preferably, sodium is used. Two or more kinds of these may be used in combination.

With respect to a non-alkali metal constituting the second fatty-acid metal salt, not particularly limited, any non-alkali metal may be used as long as the above-mentioned fatty acid salts are formed; and examples thereof include: calcium, zinc, magnesium, aluminum, strontium and barium. Preferably, calcium, zinc, magnesium and aluminum are used. Two or more kinds of these may be used combinedly.

Specific examples of the first fatty-acid metal salt include: sodium laurate, sodium tridecylate, sodium myristate, sodium pentadecylate, sodium palmitate, sodium heptadecylate, sodium stearate, sodium nonadecan acid, sodium arachic acid, potassium laurate, potassium tridecylate, potassium myristate, potassium pentadecylate, potassium palmitate, potassium heptadecylate, potassium stearate, potassium nonadecan acid, potassium arachic acid, etc. Preferably, sodium laurate, sodium palmitate and sodium stearate are used.

Specific examples of second fatty-acid metal salt include: calcium laurate, calcium palmitate, calcium stearate, zinc laurate, zinc palmitate, zinc stearate, magnesium laurate, magnesium palmitate, magnesium stearate, aluminum laurate, aluminum palmitate and aluminum stearate. Preferably, calcium laurate, calcium palmitate, calcium stearate, zinc stearate, magnesium stearate and aluminum stearate are used.

When the inorganic particles having the above-mentioned first fatty-acid metal salt and second fatty-acid metal salt deposited on the surface thereof at a predetermined rate are used as an externally additive agent, it is possible to reduce fixing and adhesion, and and scratches occurring on the photosensitive member, and consequently to improve the chargeability of a toner.

The inorganic particles of the toner of the present invention may be produced by any method as long as the above-mentioned inorganic particles having the first fatty-acid metal salt and second fatty-acid metal salt deposited on the surface thereof can be obtained. In a preferred embodiment, they are obtained by using a method in which to an aqueous system including inorganic particles is added a first fatty-acid metal salt in the presence of metal ions other than alkali metal ions so that second fatty-acid metal salt is allowed to deposit on the surface of each inorganic particle. Since the fatty-acid metal salt is insoluble or slightly soluble to any of solvents of an aqueous system and an organic system, there is not any suitable solvent. Therefore, in conventional methods, it has been difficult to carry out a coating process of the fatty-acid metal salt on each of the inorganic fine particles even by the use of a wet system. However, with this method wherein a first fatty-acid metal salt is added in the presence of metal ions other than alkali metal ions so that a second fatty-acid metal salt is allowed to deposit on the surface of each inorganic particle, it becomes possible to easily obtain inorganic fine particles, each having its surface uniformly coated with a mixture of the first fatty-acid metal salt and second fatty-acid metal salt. The following description will discuss preferred embodiments of a manufacturing method of inorganic particles in accordance with the present invention in detail.

First, a compound containing a non-alkali metal is put into an aqueous dispersion slurry of inorganic particles, and dissolved so as to allow the non-alkali metal ions to exist in the slurry. In this case, the system may be heated in order to accelerate the dissolving of the compound containing the non-alkali metal.

With respect to the content of the inorganic particles in the aqueous dispersion slurry, it is not particularly limited as long as the total amount of existence of the first fatty-acid metal salt and second fatty-acid metal salt per 1 $m^2$ of the total surface area of the inorganic particles is maintained in the above-mentioned range; and preferably, it is properly set to an amount that allows the amount of use of the inorganic fine particles accounts for 5 to 30% by weight with respect to the aqueous medium.

With respect to the non-alkali-metal-containing compound, not particularly limited, any compound may be used, as long as it contains the non-alkali metal constituting the above-mentioned desired second fatty-acid metal salt to be finally placed on the surface of each inorganic particle, and as long as it also supplies the non-alkali metal ions in the aqueous system; and examples thereof include calcium chloride, zinc chloride, magnesium chloride and aluminum chloride. An amount of addition of the non-alkali-metal-containing compound is not particularly limited, as long as it provides the above-mentioned inorganic particles of the present invention; and for example, in the case of the application of calcium chloride as the compound, the amount is preferably set in the range of 0.1 to 6 parts by weight, preferably 0.2 to 2 parts by weight, with respect to 100 parts by weight of the inorganic particles.

Then, to the slurry containing the non-alkali metal ions is added a first fatty-acid metal salt'so that the second fatty-acid metal salt, which is an insoluble component, is allowed to deposit on the surface of each particle with the inorganic particle as a core. At the time of adding the first fatty-acid metal salt to the slurry, the slurry is preferably heated since the first fatty-acid metal salt has a low solubility to water.

The first fatty-acid metal salt to be added is finally formed into the above-mentioned desired first fatty-acid metal salt to be placed on the surface of each inorganic particle through an ionic reaction. The amount of addition of the first fatty-acid metal salt is not particularly limited as long as it provides the inorganic fine particles of the present invention; and it is preferably set to such an amount that the molar number of addition of the first fatty-acid metal salt becomes greater than the value obtained by multiplying the molar number of addition of the non-alkali-metal-containing compound by the number of valence of the non-alkali metal. In general, for example, in the case when calcium chloride is used as the non-alkali-metal-containing compound while sodium stearate is used as the first fatty-acid metal salt, the amount of use of the first fatty-acid metal salt is preferably set in the range of 1 to 35 parts by weight, preferably 1 to 10 parts by weight, more preferably 2 to 5 parts by weight, with respect to 100 parts by weight of the inorganic particles.

The mechanism in which the second fatty-acid metal salt is allowed to deposit on the surface of each inorganic particle is represented by the following reaction formula by exemplifying the case in which calcium chloride is used as the non-alkali-metal-containing compound while sodium stearate is used as the first fatty-acid metal salt.

[Formula 1]

$$H_2O+CaCl_2 \rightarrow Ca^{2+}+2Cl^-+H_2O\ Ca^{2+}+2Cl^-+2C_{17}H_{35}COONa \rightarrow (C_{17}H_{35}COO)_2Ca\downarrow+2Na^++2Cl^-$$

It is considered that, through these reactions, calcium stearate is allowed to deposit on the surface of each inorganic particle with the particle as a core so that the inorganic particle the surface of which is uniformly coated with a mixture of sodium stearate and calcium stearate is obtained.

Thereafter, the aqueous medium is removed from the reaction system, and the resulting reactant is washed with an aqueous washing liquid such as water, dried and pulverized to provide desired inorganic particles. A comparatively large amount of first fatty-acid metal salt remains on the surface of each inorganic particle before washing. For this reason, the first fatty-acid metal salt is removed by washing so that the rate of the first fatty-acid metal salt to the second fatty-acid metal salt is controlled to be set within the above-mentioned range.

After the surface has been coated with the first fatty-acid metal salt and second fatty-acid metal salt, it. is preferable for the resulting inorganic particle to have an average primary particle size in the range of 10 to 3,000 nm, preferably 100 to 1,100 nm.

The inorganic fine particles of the present invention, obtained by the method as described above, makes it possible to carry out an externally adding treatment to the surface of each toner particle in an excellent dispersion state. This is supposedly because the coating of the first fatty-acid metal salt and second fatty-acid metal salt on each inorganic particle is formed in an excellently uniform manner. It is considered that this uniform coating treatment is achieved by the above-mentioned method in which the first fatty-acid metal salt is added to the inorganic particle slurry in the presence of non-alkali metal ions so as to allow the second fatty-acid metal salt on the surface of each inorganic -particle.

Moreover, the second fatty-acid metal salt and first fatty-acid metal salt that are allowed to adhere to the inorganic particles through the above-mentioned method exert a superior lubricating effect to form a lubricating coat film on the surface of the photosensitive member, thereby reducing a frictional force between the blade and the photosensitive member, and subsequently improving the cleaning performance. In particular, in the case when the inorganic particles prior to the coating is set to have an average primary particle size in the range of 0.1 μm to 2 μm, the inorganic particles, even when separated from the toner, are blocked by the cleaning blade to form a stable blocking layer against particles because of the lubricating properties of the inorganic particles themselves; thus, since this layer properly blocks other toner additives separated from the toner at the time of cleaning, it is possible to restrict ultra-fine powder from passing through it, and consequently to further improve the cleaning properties.

Moreover, the inorganic particles, obtained from the above-mentioned method, serve as a fluidity-improving agent, thereby exerting a frictional force-reducing effect, which provides an additional effect of the present invention. Therefore, even in the case of the application of magnetite, etc. that forms hard inorganic oxide fine powder and a magnetic toner, it is possible to reduce abrasion on an organic photosensitive member.

The toner particles to which the above-mentioned inorganic particles are externally added are composed of at least a binder resin and a colorant.

With respect to the binder resin constituting the toner particles, any known resin in the fields such as electrophotography and electrostatic printing may be used; and for example, the following resins are preferably used: styrenic resins; acrylic resins such as alkyl acrylate and alkyl methacrylate; styrene-acrylic copolymer resins; polyester resins; silicone resins; olefin resins; amide resins; or epoxy resins. In particular, in the case of the application to full-color toners, in order to improve the OHP light-transmitting properties and color reproducibility in superposed images, resins which has a high transparency, a low viscosity in the fusing properties and a sharply melting property are demanded, and polyester resins are suitable as resins having such properties.

With respect to the colorant, not particularly limited, conventionally known pigments and dyes may be used. Examples of them include carbon black, aniline blue, chalcoil blue, chrome yellow, ultramarine blue, DuPont Oil Red, quinoline yellow, methylene blue chloride, copper phthalocyanine, Malachite green oxalate, Lump Black, Rose Bengal, C.I. Pigment Red 48:1, C.I. Pigment Red 122, C.I. Pigment Red 57:1, C.I. Pigment Red 184, C.I. Pigment Yellow 97, C.I. Pigment Yellow 12, C.I. Pigment Yellow 17, C.I. Solvent Yellow 162, C.I. Pigment Blue 15:1, C.I. Pigment Blue 15:3, etc. In the case of the application as a magnetic toner, one portion or all the portion of the colorant may be replaced by a magnetic material. Examples of such a magnetic material include magnetite, ferrite, iron powder, nickel, etc. In the case when the colorant is used for a color toner, the colorant is highly dispersed preliminarily in a binder resin by a master-batch process or a flushing process, and this is then preferably used. A content of the colorant is preferably set in the range of 2 to 15 parts by weight with respect to 100 parts by weight of the binder resin.

Additives such as a mold-releasing agent and a charge-control agent may be added to the toner particles, if necessary.

The mold-releasing agent is not particularly limited, and examples thereof include: polyethylene wax, polypropylene wax, carnauba wax, rice wax, sazol wax, montan ester waxes, Fischer-Tropsch wax, etc.

With respect to the charge-control agent, examples of those charge-control agents used for positively chargeable toners include: azine compound Nigrosine Base EX, Bontron N-01, 02, 04, 05, 07, 09, 10, 13 (made by Orient Chemical Co., Ltd.), Oil Black (made by Chuo Gosei Kagaku K.K.), quaternary ammonium salt P-51, polyamine compound P-52, Sudan Chief Schwaltz BB (Solvent Black 3: C.I. No. 26150), Fet Schwaltz HBN (C. I. No. 26150), Brilliant Spirits Schwaltz TN (Byer Corp.), and moreover, alkoxylated amine, alkyl amide, molybdenum acid chelate pigments, imidazole-based compounds, etc. may be used. Moreover, with respect to those charge control agents used for negatively chargeable toners include: chromium complex azo dyes S-32, 33, 34, 35, 37, 38 and 40 (made by Orient Kagakukogyo K.K.) and Aizen Spilon Black TRH, BHH (made by Hodogaya Kagaku K.K.), Kayaset Black T-22, 004 (made by Nippon Kayaku K.K.), copper-phthalocyanine-based dye S-39 (made by Orient Kagakukogyo K.K.), chromium complexes E-81, 82 (made by Orient Kagakukogyo K.K.), zinc complex E-84 (made by Orient Kagakukogyo K.K.), aluminum complex E-86 (made by Orient Kagakukogyo K.K.), and moreover, calix arene compounds, etc. may be used. Furthermore, with respect to negative charge-control agents used for full-color toners, those charge-control agents that are colorless, white or thin-colored and give no adverse effects on the color tones and light-transmitting property of the color toner may be used; and for example, zinc salicylic acid derivatives, chromium complexes, calix arene compounds, organic boron compounds and fluorine-containing quaternary ammonium salt compounds may be preferably used. With respect to salicylic acid metal complexes, for example, those disclosed in U.S. Pat. No. 4,206,064, and U.S. Pat. No. 4,762,763 may be used. With respect to calix arene compounds, for example, those disclosed in U.S. Pat. No. 5,049,467 may be used. With respect to organic boron compounds, those disclosed in U.S. Pat. No. 5,863,692 may be used. With respect to fluorine-containing quaternary ammonium compounds, those disclosed in U.S. Pat. No. 5,069,994 may be used.

With respect to the manufacturing method of the toner particles, any known method may be used; and for example, a dry pulverizing method, a wet emulsion polymerization method, a suspension polymerization method, an emulsion granulating method, etc. are listed. In general, in the case of the pulverizing method, particles having irregular shape can be obtained, and in the case of the wet method, spherical particles can be obtained; thus, a toner manufacturing method suitable for the image-forming process may be selectively used. From the viewpoint of image quality, those toner particles having a small particle size are preferable, and those having a volume average particle size in the range of 4 to 10 μm are preferably used. In particular, in the present invention the toner particles are preferably set to have a volume average particle size in the range of 4 to 8 μm.

The toner of the present invention is obtained by externally adding the inorganic particles to the toner particles, and mixing these. The amount of addition of the inorganic particles in the present invention is preferably set in the range of 0.1 to 5% by weight, preferably 0.3 to 3% by weight, from the viewpoint of the BS prevention effect and better chargeability.

In the case when, prior to the coating, the inorganic particles have an average primary particle size of not less than 0.1 μm, it is preferable to externally add inorganic particles having an average primary particle size of not more than 0.1 μm in combination. Thus, it becomes possible to improve the toner fluidity. With respect to the inorganic particles having an average primary particle size of not more than 0.1 μm, known inorganic particle materials may be used; and for example, silica, amorphous silica, titania, alumina, etc. are exemplified. The inorganic particles are preferably subjected to a surface treatment by using a known hydrophobic treatment agent, such as silane coupling agent and silicone oil, and then applied thereto. An amount of addition of the inorganic particles is preferably set in the range of 0.1 to 3% by weight with respect to the toner particles.

In an attempt to remove matters fixed or adhered to P/C, a cleaning-assist agent may be externally added. With respect to the cleaning-assist agent, for example, titanate compounds such as large-size titania and strontium titanate, silicate compounds and calcined particles, etc. are exemplified. These particles are preferably set to have an average primary particle size in the range of 100 to 1000 nm.

The toner of the present invention can be applied to both of a one-component developer that does not use a carrier and a two-component developer that is used together with a carrier. The toner of the present invention may be either of magnetic and non-magnetic toners.

With respect to the carrier used together with the toner of the present invention, known carriers may be used; and for example, any of the following carriers may be used: carriers made of magnetic particles such as iron powder and ferrite, coat-type carriers having magnetic particles the surface of which is coated with a coating agent such as a resin, and binder-type carriers in which magnetic particles are dispersed in a binder resin. With respect to the carriers, it is preferable to use those having a volume average particle size in the range of 20 to 70 $\mu$m, preferably 30 to 50 $\mu$m, may be used.

The following description will discuss the present invention by means of examples in more detail; however, the present invention is not limited by these examples.

EXAMPLES

<Preparation of externally additive agent A (deposition method)>

To an aqueous slurry formed by dispersing 100 g of titania particles (BET specific surface area: 10 $m^2/g$) having an average primary particle size of 300 nm in 1 liter of pure water was added 0.55 g of calcium chloride (non-alkali metal containing compound), and sufficiently stirred. At the time when the calcium chloride was completely dissolved, 3.1 g of sodium stearate (first fatty-acid metal salt) was put into the slurry, while it was being heated; thus, calcium stearate (second fatty-acid metal salt) was allowed to deposit on each titania particle with the titania particle as a core, and the solution after the reaction was removed, the resulting titania particles, obtained after a washing process, was dried, pulverized by a jet mill, and further filtered through a sieve of 105 $\mu$m in mesh to produce titania particles (externally additive agent A) having an average particle size of 350 nm, the surface of which was treated so that the calcium stearate and sodium stearate deposited thereon at a ratio of 3% by weight (amount of the surface treatment) with respect to the amount of application of the titania particles. In the resulting surface-treated titania particles, the rate (content) of the sodium stearate (first fatty-acid metal salt) to the calcium stearate (second fatty-acid metal salt) was measured by a fluorescent X-ray analyzer, with the result that 0.1% by weight was obtained.

<Preparation of externally additive agents B to L, N, R and S (disposition method)>

The same methods as the preparation method of the externally additive agent A were carried out, except that the kind, particle size and BET specific surface area of the inorganic particles, the kind and amount of addition of the non-alkali metal-containing compound and the kind and amount of addition of the first fatty-acid metal salt were changed to those shown in Tables 1 and 2, so that the respective externally additive agents were prepared.

<Preparation of externally additive agents M (conventional method)>

Calcium stearate was dispersed in a xylene solvent, and this was dissolved in a hot bath at approximately 100° C. Then, titania particles (BET specific surface area: 10 $m^2/g$) having an average primary particle size of 300 nm were added to the xylene solution so that the amount of treatment of the calcium stearate to the titania particles was set to 3% by weight, and the resultant mixture was stirred. Thereafter, this mixture was deaerated by using an evaporator, and dried to provide a treated product. The treated product was then pulverized by a jet mill, and filtered through a sieve of 105 $\mu$m in mesh to produce the resulting titania particles (externally additive agent M) subjected to a calcium stearate treatment, having an average particle size of 600 nm.

<Preparation of externally additive agents O (conventional method)>

The same method as the preparation method of the externally additive agent M were carried out except that sodium stearate was used instead of calcium stearate to prepare an externally additive agent O.

<Externally additive agents P and Q>

Calcium stearate having an average particle size of 5 $\mu$m was used as an externally additive agent P.

Sodium stearate having an average particle size of 5 $\mu$m was used as an externally additive agent Q.

The ratio (content) of the first fatty-acid metal salt to the second fatty-acid metal salt and the amount of surface treatment were measured in the respective externally additive agents, in the same manner as the externally additive agent A. The results thereof, together with condition of preparation, are shown in the following Tables. Here, "Tita-St" refers to strontium titanate.

TABLE 1

| | Inorganic particle | | | Non-alkalimetal-containing compound | | First fatty-acid metal salt | | Kind of second fatty-acid metal salt | Amount of surface treatment | Content | Average particle |
|---|---|---|---|---|---|---|---|---|---|---|---|
| | Kind | Particle size (nm) | Surface treating method | Kind | Amount of addition (g) | Kind | Amount of addition (g) | deposited | *** (Weight %) | (%) **** | size (nm) |
| Externally additive agent-A | Titania | 300 | Deposition method | $CaCl_2$ | 0.55 | Na Stearate | 3.1 | Ca Stearate | 3 | 0.1 | 350 |
| Externally additive agent-B | Titania | 300 | Deposition method | $CaCl_2$ | 0.28 | Na Stearate | 1.6 | Ca Stearate | 1.5 | 0.1 | 350 |
| Externally additive agent-C | Titania | 300 | Deposition method | $CaCl_2$ | 0.6 | Na Palmitate | 3.1 | Ca Palmitate | 3 | 0.1 | 350 |

TABLE 1-continued

| | Inorganic particle | | | Non-alkalimetal-containing compound | | First fatty-acid metal salt | | Kind of second fatty-acid metal salt deposited | Amount of surface treatment *** (Weight %) | Content (%) **** | Average particle size (nm) |
|---|---|---|---|---|---|---|---|---|---|---|---|
| | Kind | Particle size (nm) | Surface treating method | Kind | Amount of addition (g) | Kind | Amount of addition (g) | | | | |
| Externally additive agent-D | Titania | 300 | Deposition method | $CaCl_2$ | 0.75 | Na Laurate | 3.1 | Ca Laurate | 3 | 0.1 | 350 |
| Externally additive agent-E | Titania | 300 | Deposition method | $ZnCl_2$ | 0.65 | Na Stearate | 3.0 | Zn Stearate | 3 | 0.1 | 350 |
| Externally additive agent-F | Titania | 300 | Deposition method | $MgCl_2$ | 0.49 | Na Stearate | 3.2 | Mg Stearate | 3 | 0.1 | 350 |
| Externally additive agent-G | Titania | 300 | Deposition method | $AlCl_3$ | 0.46 | Na Stearate | 3.2 | Al Stearate | 3 | 0.1 | 350 |
| Externally additive agent-H | Titania | 30 | Deposition method | $CaCl_2$ | 3.3 | Na Stearate | 18.6 | Ca Stearate | 18 | 0.1 | 35 |
| Externally additive agent-I | Titania | 1000 | Deposition method | $CaCl_2$ | 0.55 | Na Stearate | 3.1 | Ca Stearate | 3 | 0.1 | 1100 |
| Externally additive agent-J | Silica | 30 | Deposition method | $CaCl_2$ | 3.3 | Na Stearate | 18.6 | Ca Stearate | 18 | 0.1 | 35 |
| Externally additive agent-K | Alu-mina | 20 | Deposition method | $CaCl_2$ | 5.5 | Na Stearate | 31 | Ca Stearate | 30 | 0.1 | 23 |
| Externally additive agent-L | Tita-St | 300 | Deposition method | $CaCl_2$ | 0.55 | Na Stearate | 3.1 | Ca Stearate | 3 | 0.1 | 350 |

***Ratio of an increase in the weight of the inorganic particles caused by the surface treatment to the weight of the inorganic particles supplied to the treatment.
****Ratio of the first fatty-acid metal salt to the second fatty-acid metal salt.

TABLE 2

| | Inorganic particle | | | Non-alkalimetal-containing compound | | First fatty-acid metal salt | | Kind of second fatty-acid metal salt deposited | Amount of surface treatment *** (Weight %) | Content (%) **** | Average particle size (nm) |
|---|---|---|---|---|---|---|---|---|---|---|---|
| | Kind | Particle size (nm) | Surface treating method | Kind | Amount of addition (g) | Kind | Amount of addition (g) | | | | |
| Externally additive agent-M | Titania | 300 | Con-ventional method | The applied fatty-acid metal salt was Ca stearate. | | | | | 3 | 0 | 600 |
| Externally additive agent-N | Titania | 300 | Deposition method | $CaCl_2$ | 0.55 | Na Stearate | 3.5 | Ca Stearate | 3 | 0.6 | 350 |
| Externally additive agent-O | Titania | 300 | Con-ventional method | The applied fatty-acid metal salt was Na stearate. | | | | | 3 | — | 550 |
| Externally additive agent-P | Ca* Stearate | 5 μm | — | — | — | — | — | — | — | — | — |
| Externally additive agent-Q | Na* Stearate | 5 μm | — | — | — | — | — | — | — | — | — |
| Externally additive agent-R | Titania | 300 | Deposition method | $CaCl_2$ | 0.55 | Na Stearate | 4.0 | Ca Stearate | 3 | 0.8 | 350 |
| Externally additive agent-S | Titania | 300 | Deposition method | $CaCl_2$ | 1.0 | Na Stearate | 3.1 | Ca Stearate | 3 | <0.01 ** | 350 |

*The fatty-acid metal salt described was pulverized and used as an externally additive agent as it was.
**No detectiion indicated that the value was smaller than the minimum value detectable by the fluorescent X-ray analysis.
***Ratio of an increase in the weight of the inorganic particles caused by the surface treatment to the weight of the inorganic particles supplied to the treatment.
****Ratio of the furst fatty-acid metal salt to the second fatty-acid metal salt.

<Preparation of toner particles>

Bisphenol-based polyester resin 70 parts by weight (Tg: 58° C., Tm: 100° C.)

Magenta pigment (C. I. Pigment Red 184) 30 parts by weight

A mixture having the above-mentioned composition was loaded into a pressing kneader, and kneaded. The resulting kneaded material was cooled, and pulverized in a feather mill to provide a pigment master batch.

The above-mentioned polyester resin 93 parts by weight

The above-mentioned master batch 10 parts by weight

The ingredient having the above-mentioned composition was mixed in Henschel mixer, and then kneaded by a bent twin-screw kneader. After cooled, the kneaded material was coarsely pulverized in a feather mill, finely pulverized in a jet mill, and then classified to provide magenta toner particles having a volume average particle size of 8.5 μm. The particle size of the toner was measured by means of Coulter Multisizer II.

<Preparation of toners of Examples and Comparative Examples>

As shown in Table 3, each of the externally additive agents was added to the toner particles, mixed in Henschel mixer, and filtered through a sieve shaker to prepare a toner. With respect to the hydrophobic silica, H2000 (made by Clariant Japan K.K.; average primary particle size: 10 nm, BET specific surface area: 180 $m^2/g$ ) was used. The amount of addition (% by weight) of the respective externally additive agents, shown in the Table, represents the ratio with respect to the toner particles. In the Table, with respect to Comparative Example 6, the amounts of addition of the externally additive agent P and the hydrophobic silica represent the respective ratios to the toner particles, and the amount of addition of the externally additive agent Q represents the ratio to the amount of addition of the externally additive agent P.

<Preparation of two-component developer>

The respective toners obtained in the respective Examples and Comparative Example were mixed with carrier 1, which will be described later, and stirred so that the toner content in the developer was 6% by weight to give two-component developers.

Carrier 1

To a flask of 500 ml equipped with a stirring device, a condenser, a thermometer, a nitrogen introducing tube and a dripping device was added 100 parts by weight of methylethylketone. Separately, to 100 parts by weight of methylethylketone were added and dissolved 36.7 parts by weight of methylmethacrylate, 5.1 parts by weight of 2-hydroxylethylmethacrylate, 58.2 parts by weight of 3-methacryloxypropyltris(trimethylsiloxy)silane and 1 part by weight of 1,1'-azobis (cyclohexane-1-carbonitrile) at 80° C. under a nitrogen atmosphere to prepare a solution. This solution was dripped into the above-mentioned flask for two hours and matured for five hours to obtain a resin.

To the resulting resin was added an isophoronediisocyanate/trimethylolpropane adduct (IPDI/TMP series: NCO%=6.1%) as a cross-linking agent, so as to adjust the OH/NCO mole ratio to 1/1, and this was diluted by methylethylketone so that a coat resin solution having a solid component ratio of 3% by weight.

By using calcined ferrite particles F-300(made by Powdertech K.K.) having a volume average particle size of 50 $\mu$m as a core material, the coat resin solution was applied thereto and dried by Spira Cota (made by Okada Seiko K.K.) so that the amount of coated resin to the core material is set at 1.5% by weight.

The resultant carrier was left in a hot-air circulating oven for one hour at 160° C. so as to be cured. After having been cooled off, the ferrite particle bulk was pulverized by using a sieve shaker having screen meshes of 106 $\mu$m and 75 $\mu$m to give a resin-coated carrier 1.

<Evaluation>

Evaluation was made on the respective developers obtained from the Examples and Comparative Example in the following method with respect to the respective evaluation items:

BS

The developer was set in a full-color copying machine (CF900: made by Minolta Co., Ltd.), and 30,000 copies were continuously made by using a document having an image portion of 15%. Evaluation was made by visually observing black spots (BS) on images.

◎: No BS observed;

○: BS slightly observed; however, no problem arose in practical use;

Δ: BS observed, raising problems in practical use; and

X: A number of BS occurred.

Image Noise

The developer was set in a full-color copying machine (CF900: made by Minolta Co., Ltd.), and 30,000 copies were continuously made by using a document having an image portion of 15%. Evaluation was made by visually observing scratches on the surface of the photosensitive member. When scratches occur on the surface of the photosensitive member, image noise appears on a copied image as lines.

○: No scratches observed on the surface of the photosensitive member;

X: Scratches observed on the surface of the photosensitive member.

Fog

The developer was set in a full-color copying machine (CF900: made by Minolta Co., Ltd.), and 30,000 copies were continuously made by using a document having an image portion of 15%. Evaluation was made by visually observing fog on the surface of the images. When the chargeability is lowered, fog occurs.

○: No fog observed;

Δ: Fog slightly observed; and x: A large amount of fog observed.

The results of the above-mentioned evaluation are shown in the following Tables together with the conditions of the externally additive agents in the respective developers.

TABLE 3

| | Kind of externally additive agents | Amount of addition | Kind of externally additive agents | Amount of addition | BS after 30,000 copies | Image noise | Fog |
|---|---|---|---|---|---|---|---|
| Example 1 | Externally additive agent-A | 1.00% | Hydrophobic silica | 1.00% | ◎ | ○ | ○ |
| Example 2 | Externally additive agent-B | 1.00% | Hydrophobic silica | 1.00% | ◎ | ○ | ○ |
| Example 3 | Externally additive agent-C | 1.00% | Hydrophobic silica | 1.00% | ◎ | ○ | ○ |
| Example 4 | Externally additive agent-D | 1.00% | Hydrophobic silica | 1.00% | ◎ | ○ | ○ |
| Example 5 | Externally additive agent-E | 1.00% | Hydrophobic silica | 1.00% | ◎ | ○ | ○ |
| Example 6 | Externally additive agent-F | 1.00% | Hydrophobic silica | 1.00% | ◎ | ○ | ○ |
| Example 7 | Externally additive agent-G | 1.00% | Hydrophobic silica | 1.00% | ◎ | ○ | ○ |
| Example 8 | Externally additive agent-H | 1.00% | — | — | ○ | ○ | ○ |
| Example 9 | Externally additive agent-I | 1.00% | Hydrophobic silica | 1.00% | ◎ | ○ | ○ |
| Example 10 | Externally additive agent-J | 1.00% | — | — | ○ | ○ | ○ |
| Example 11 | Externally additive agent-K | 1.00% | — | — | ○ | ○ | ○ |
| Example 12 | Externally additive agent-L | 1.00% | Hydrophobic silica | 1.00% | ◎ | ○ | ○ |
| Comparative example 1 | Externally additive agent-M | 1.00% | Hydrophobic silica | 1.00% | ○ | X | ○ |
| Comparative example 2 | Externally additive agent-N | 1.00% | Hydrophobic silica | 1.00% | ◎ | ○ | X |
| Comparative example 3 | Externally additive agent-O | 1.00% | Hydrophobic silica | 1.00% | ○ | X | ○ |

TABLE 3-continued

| | Kind of externally additive agents | Amount of addition | Kind of externally additive agents | Amount of addition | BS after 30,000 copies | Image noise | Fog |
|---|---|---|---|---|---|---|---|
| Comparative example 4 | Externally additive agent-P | 1.00% | Hydrophobic silica | 1.00% | Δ | ○ | X |
| Comparative example 5 | Externally additive agent-Q | 1.00% | Hydrophobic silica | 1.00% | Δ | ○ | X |
| Comparative example 6 | Externally additive agent-P<br>Externally additive agent-Q | 1.00%<br>0.1* | Hydrophobic silica | 1.00% | Δ | ○ | X |
| Comparative example 7 | Externally additive agent-R | 1.00% | Hydrophobic silica | 1.00% | ⊙ | ○ | X |
| Comparative example 8 | Externally additive agent-S | 1.00% | Hydrophobic silica | 1.00% | Δ | ○ | ○ |

*The amount of addition of externally additive agent Q in Comparative Example 6 represents the ratio to the amount of addition of externally additive agent P.

The present invention makes it possible to improve BS properties without causing any adverse effects such as degradation in chargeability and image noise, as compared with conventional techniques. The present invention also effects to reduce abrasion in the photosensitive member, and improves cleaning properties.

What is claimed is:

1. A toner comprising:

toner particles containing a binding resin and a colorant;

an externally additive agent externally added to the toner particles, the additive agent being inorganic particles which have a first fatty-acid metal salt and a second fatty-acid metal salt on the surface thereof, the first fatty-acid metal salt having a metal that is an alkaline metal, the second fatty-acid metal salt having a metal that is other than an alkali metal, a ratio of the first fatty-acid metal salt to the second fatty-acid metal salt being set in the range of 0.01 to 0.5% by weight.

2. The toner of claim 1, wherein the metal of the first fatty-acid metal salt is sodium or potassium, and the metal of the second fatty-acid metal salt is at least a metal selected from the group consisting of calcium, zinc, magnesium, aluminum, strontium and barium.

3. The toner of claim 1, wherein the metal of the first fatty-acid metal salt is sodium, and the metal of the second fatty-acid metal salt is at least a metal selected from the group consisting of calcium, zinc, magnesium and aluminum.

4. The toner of claim 1, wherein the externally additive agent is obtained by adding the first fatty-acid metal salt to an aqueous system containing inorganic particles in the presence of metal ions other than alkali metal ions so as to allow the second fatty-acid metal salt to deposit on the surface of each inorganic particle.

5. The toner of claim 1, wherein the first fatty-acid metal salt has a fatty acid that is a saturated fatty acid having 6 to 25 carbon atoms.

6. The toner of claim 1, wherein the second fatty-acid metal salt has a fatty acid that is a saturated fatty acid having 6 to 25 carbon atoms.

7. The toner of claim 1, wherein the fatty acid of the first fatty-acid metal salt is the same as the fatty acid of the second fatty-acid metal salt.

8. The toner of claim 1, wherein the externally additive agent has an average primary particle size in a range of 10 to 3000 nm.

9. The toner of claim 1, wherein the externally additive agent has an average primary particle size in a range of 100 to 1100 nm.

10. The toner of claim 1, wherein second inorganic fine particles having an average primary particle size of not more than 0.1 μm are externally added to the toner particles.

11. The toner of claim 1, the toner particles are obtained by a wet method and have a volume average particle size of 4 to 8 μm.

12. The toner of claim 1, the toner particles are obtained by a pulverizing method and have a volume average particle size of 4 to 8 μm.

13. The toner of claim 1, wherein the colorant is a colorant that has been subjected to a master batch process, or a colorant that has been subjected to a flushing process.

14. An additive agent for toner, comprising:

inorganic particles;

a first fatty-acid metal salt existing on the surface of the inorganic particles, the first fatty acid metal salt having a metal that is an alkali metal; and a second fatty-acid metal salt existing on-the surface of the inorganic particles, the second fatty-acid metal salt having a metal other than an alkali metal, a ratio of the first fatty-acid metal salt to the second fatty-acid metal salt being set in a range of 0.01 to 0.5% by weight.

15. The additive agent for toner of claim 14, wherein the metal of the first fatty-acid metal salt is sodium or potassium, and the metal of the second fatty-acid metal salt is at least a metal selected from the group consisting of calcium, zinc, magnesium, aluminum, strontium and barium.

16. The additive agent for toner of claim 14, wherein the additive agent is obtained by adding the first fatty-acid metal salt to an aqueous system containing inorganic particles in the presence of metal ions other than alkali metal ions so as to allow the second fatty-acid metal salt to deposit on the surface of inorganic particle.

17. The additive agent for toner of claim 14, wherein the first fatty-acid metal salt has a fatty acid that is a saturated fatty acid having 6 to 25 carbon atoms.

18. The additive agent for toner of claim 14, wherein the second fatty-acid metal salt has a fatty acid that is a saturated fatty acid having 6 to 25 carbon atoms.

19. The additive agent for toner of claim 14, wherein the fatty acid of the first fatty-acid metal salt is the same as the fatty acid of the second fatty-acid metal salt.

20. The additive agent for toner of claim 14, wherein the additive agent has an average primary particle size in a range of 10 to 3000 nm.

* * * * *